US007958635B2

(12) United States Patent
Yoshida et al.

(10) Patent No.: US 7,958,635 B2
(45) Date of Patent: Jun. 14, 2011

(54) PROCESS FOR PRODUCING A PULLEY FOR A CONTINUOUSLY VARIABLE BELT DRIVE TRANSMISSION

(75) Inventors: Makoto Yoshida, Kanagawa (JP); Yoshiaki Katou, Kanagawa (JP); Yasuo Ito, Kanagawa (JP)

(73) Assignee: JATCO Ltd, Fuji-shi (JP)

( * ) Notice: Subject to any disclaimer, the term of this patent is extended or adjusted under 35 U.S.C. 154(b) by 1774 days.

(21) Appl. No.: 11/086,665

(22) Filed: Mar. 23, 2005

(65) Prior Publication Data

US 2005/0217111 A1 Oct. 6, 2005

(30) Foreign Application Priority Data

Mar. 26, 2004 (JP) ..... 2004-091985

(51) Int. Cl.
*B21K 1/42* (2006.01)

(52) U.S. Cl. ..... 29/892.11; 29/892; 474/8; 474/174; 474/188

(58) Field of Classification Search ..... 29/892, 29/90.01, 894, 892.11; 474/8, 174, 188; 384/462

See application file for complete search history.

(56) References Cited

U.S. PATENT DOCUMENTS

| | | | | |
|---|---|---|---|---|
| 4,947,533 | A | 8/1990 | Taniguchi et al. | |
| 5,011,461 | A | 4/1991 | Brouwers | |
| 5,829,135 | A * | 11/1998 | Koneda et al. | 29/892.11 |
| 6,045,474 | A | 4/2000 | Smeets et al. | |
| 6,254,503 | B1 | 7/2001 | Chiba et al. | |
| 6,290,397 | B1 * | 9/2001 | Hashimoto | 384/462 |
| 2002/0183152 | A1 | 12/2002 | Kobayashi | |

FOREIGN PATENT DOCUMENTS

| | | | |
|---|---|---|---|
| DE | 101 50 315 | A1 | 12/2002 |
| JP | 62-184270 | A | 8/1987 |
| JP | 05-010405 | A | 1/1993 |
| JP | 8-260125 | A | 10/1996 |
| JP | 2001-065651 | A | 3/2001 |
| JP | 2002-139114 | A | 5/2002 |

OTHER PUBLICATIONS

M. Yoshida, U.S. PTO Office Action, U.S. Appl. No. 11/086,666, May 23, 2008, 17 pages.
U.S. Appl. No. 11/086,666, filed Mar. 23, 2005, Yoshida et al.
DIN EN ISO 4287: Oberflä chenbeschaffenheit: Tastschnittverfahren, Oct. 1998, p. 7.
M. Yoshida, U.S. Office Action, U.S. Appl. No. 11/086,666, Jan. 6, 2009, 12 pgs.
M. Yoshida, U.S. PTO Office Action, U.S. Appl. No. 11/086,666, dated Jan. 5, 2010, 14 pages.
U.S. PTO Office Action, U.S. Appl. No. 11/086,666, dated Aug. 18, 2009, 17 pages.
M. Yoshida, U.S. PTO Notice of Allowance, U.S. Appl. No. 11/086,666, dated Jun. 10, 2010, 8 pages.

* cited by examiner

*Primary Examiner* — Rick K Chang
(74) *Attorney, Agent, or Firm* — Foley & Lardner LLP

(57) ABSTRACT

A process for producing a pulley for a belt drive CVT, including subjecting tapered surfaces of a preform of at least one of input and output pulleys to surface hardening, subjecting the surface-hardened tapered surfaces of the preform to hard turning to form microgrooves radially spaced from one another thereon, between which microprojections are formed, and reducing a height of the microprojections. Alternatively, a process for producing a pulley for a belt drive CVT, including subjecting tapered surfaces of a preform of at least one of input and output pulleys to surface hardening, subjecting the surface-hardened tapered surfaces of the preform to shot peening, and subjecting the shot-peened tapered surfaces of the preform to finishing to form microgrooves having a substantially equal pitch thereon.

16 Claims, 8 Drawing Sheets

PROCESS FOR PRODUCING A PULLEY FOR A CONTINUOUSLY VARIABLE BELT DRIVE TRANSMISSION

BACKGROUND OF THE INVENTION

The present invention relates to a continuously variable belt drive transmission, and more particularly to a process for producing a microstructure on a surface of a pulley which is contacted with a belt.

It is known that pulleys for continuously variable belt drive transmissions are produced through sequential steps including case hardening of a raw steel plate, cutting, hot forging, removal of scales, machining (turning or drilling), carburizing, quenching and tempering, and grinding. In the conventional arts, the pulleys are ground after the carburizing or high-frequency quenching to improve a fatigue strength thereof. Japanese Patent Application First Publication No. 8-260125 describes such pulleys.

SUMMARY OF THE INVENTION

However, the conventional art has failed to enhance a friction coefficient of the surface of the pulley which is contacted with a belt. Further, conventionally, in the case where it is intended to produce a pulley having a tapered surface with a microstructure capable of improving a friction coefficient thereof merely by a single grinding step, the use of a grindstone composed of fine abrasive particles is required. As a result, if a grinding depth of the microstructure finished is large, it tends to occur problems such as clogging of the grindstone, defective tapered surface with grinding burn and cracks, wavy ground surface caused due to self-excited vibration, resulting in a less dimensional accuracy of the resultant tapered surface.

The present invention has been made to solve the problems of the conventional art. An object of the present invention is to provide a process for producing a pulley for use in a continuously variable belt drive transmission which can be improved in a friction coefficient of the belt-contact surface thereof, and can exhibit a stable dimensional accuracy.

In one aspect of the present invention, there is provided a process for producing a pulley for a continuously variable belt drive transmission including an input pulley, an output pulley and an endless belt, the input and output pulleys having tapered surfaces contacted with the endless belt, respectively, the process comprising:

subjecting tapered surfaces of a preform of at least one of the input pulley and the output pulley to surface hardening;

subjecting the surface-hardened tapered surfaces of the preform to hard turning to form microgrooves radially spaced from one another thereon, between which microprojections are formed; and reducing a height of the microprojections to thereby provide the at least one of the input pulley and the output pulley having the tapered surfaces with the microgrooves.

In a further aspect of the present invention, there is provided a process for producing a pulley for a continuously variable belt drive transmission including an input pulley, an output pulley and an endless belt, the input and output pulleys having tapered surfaces contacted with the endless belt, respectively, the process comprising:

subjecting tapered surfaces of a preform of at least one of the input pulley and the output pulley to surface hardening;

subjecting the surface-hardened tapered surfaces of the preform to shot peening; and subjecting the shot-peened tapered surfaces of the preform to finishing to form microgrooves having a substantially-equal pitch thereon and thereby provide the at least one of the input pulley and the output pulley which has the tapered surfaces with the microgrooves.

DETAILED DESCRIPTION OF THE INVENTION

Figure 1A:
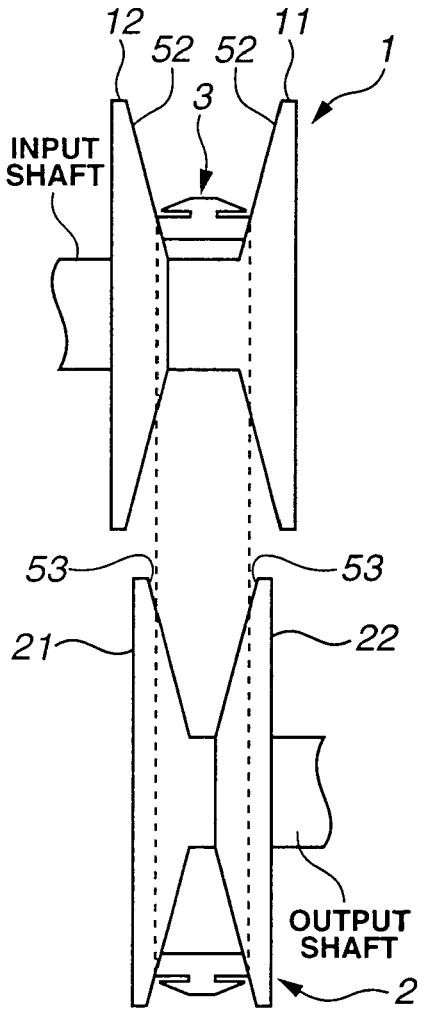
FIG. 1A is a schematic front view of a continuously variable belt drive transmission, showing input and output pulleys to which the present invention is applicable.
Figure 1B:
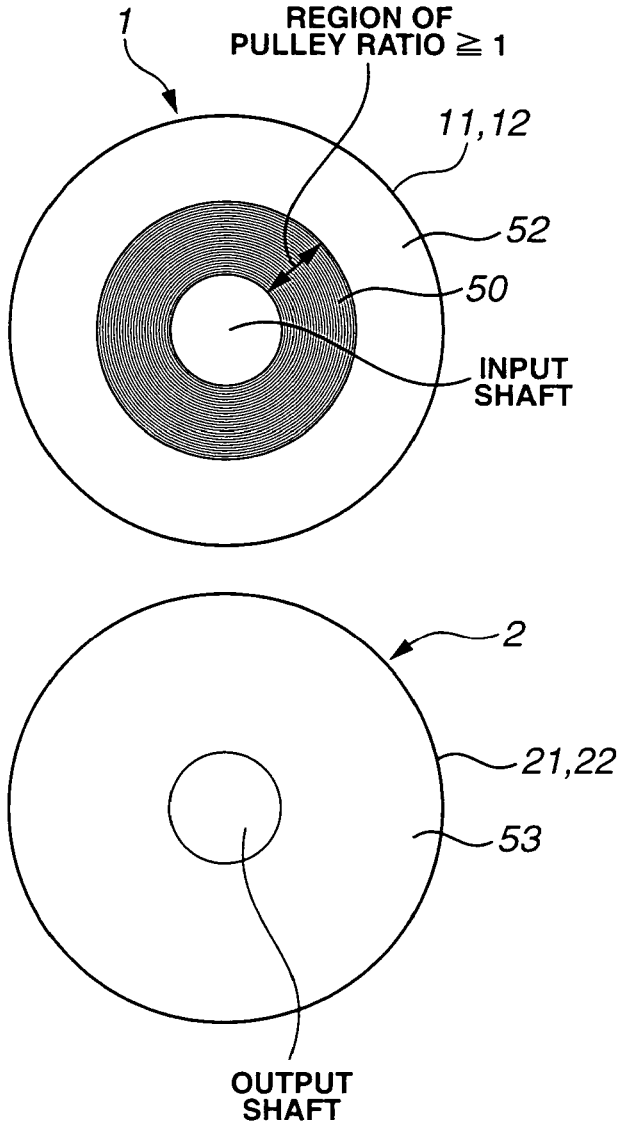
FIG. 1B is a side view of input and output pulleys for the continuously variable belt drive transmission, according to the present invention.

In the followings, embodiments of the present invention will be described with reference to the accompanying drawings. FIG. 1A schematically illustrates a relative arrangement of primary pulley 1, secondary pulley 2 and endless belt 3 of a continuously variable belt drive transmission (hereinafter referred to as a belt drive CVT). FIG. 1B illustrates primary pulley 1 on an input shaft and secondary pulley 2 on an output shaft as viewed in an axial direction of the input and output shafts. As illustrated in FIG. 1A, primary pulley 1 as an input pulley is constructed of stationary pulley half 11 formed integrally with the input shaft, and moveable pulley half 12 moveable in an axial direction of the input shaft. Similarly, secondary pulley 2 as an output pulley is constructed of stationary pulley half 21 formed integrally with the output shaft, and moveable pulley half 22 moveable in an axial direction of the output shaft. Endless belt 3 is fitted between primary and secondary pulleys 1 and 2 and engaged in a V-shaped groove between stationary pulley half 11 and moveable pulley half 12 of primary pulley 1 and in a V-shaped groove between stationary pulley half 21 and moveable pulley half 22 of secondary pulley 2. The respective V-shaped grooves are defined by opposed tapered surfaces 52 of pulley halves 11 and 12 of primary pulley 1 and opposed tapered surfaces 53 of pulley halves 21 and 22 of secondary pulley 2. Tapered surfaces 52 are tapered toward a common axis of pulley halves 11 and 12, namely, an axis of primary pulley 1, and opposed to each other in the axial direction of primary pulley 1. Tapered surfaces 53 are tapered toward a common axis of pulley halves 21 and 22, namely, an axis of secondary pulley 2, and opposed to each other in the axial direction of secondary pulley 2. Endless belt 3 transmits input rotation of the input shaft to the output shaft. A width of each of the V-shaped grooves is variably controlled in relation to pulley thrust. The thus-constructed belt drive CVT continuously and variably changes a gear ratio.

Figure 2:
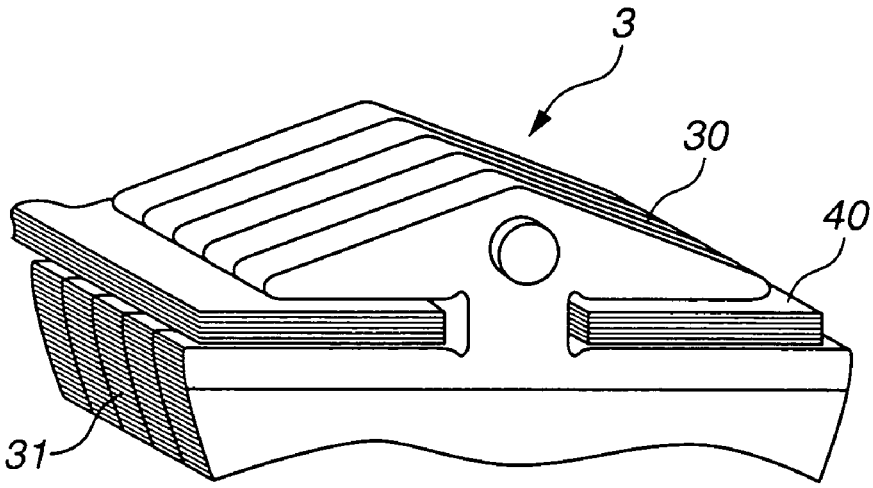
FIG. 2 is an enlarged perspective view of a part of a belt of the continuously variable belt drive transmission.

Referring to FIG. 2, there is shown a part of endless belt 3. Endless belt 3 includes a plurality of plate-shaped metal elements 30 stacked on each other in a thickness direction thereof, and a plurality of laminated metal rings 40 supporting metal elements 30 thereon. Each of metal elements 30 has side faces 31 opposed and spaced in a length direction substantially perpendicular to the thickness direction, one of which is shown in FIG. 2. Side faces 31 are contacted with tapered surfaces 52 of stationary pulley half 11 and moveable pulley half 12 of primary pulley 1 and tapered surfaces 53 of stationary pulley half 21 and moveable pulley half 22 of secondary pulley 2 as shown in FIG. 1A.

Figure 3:
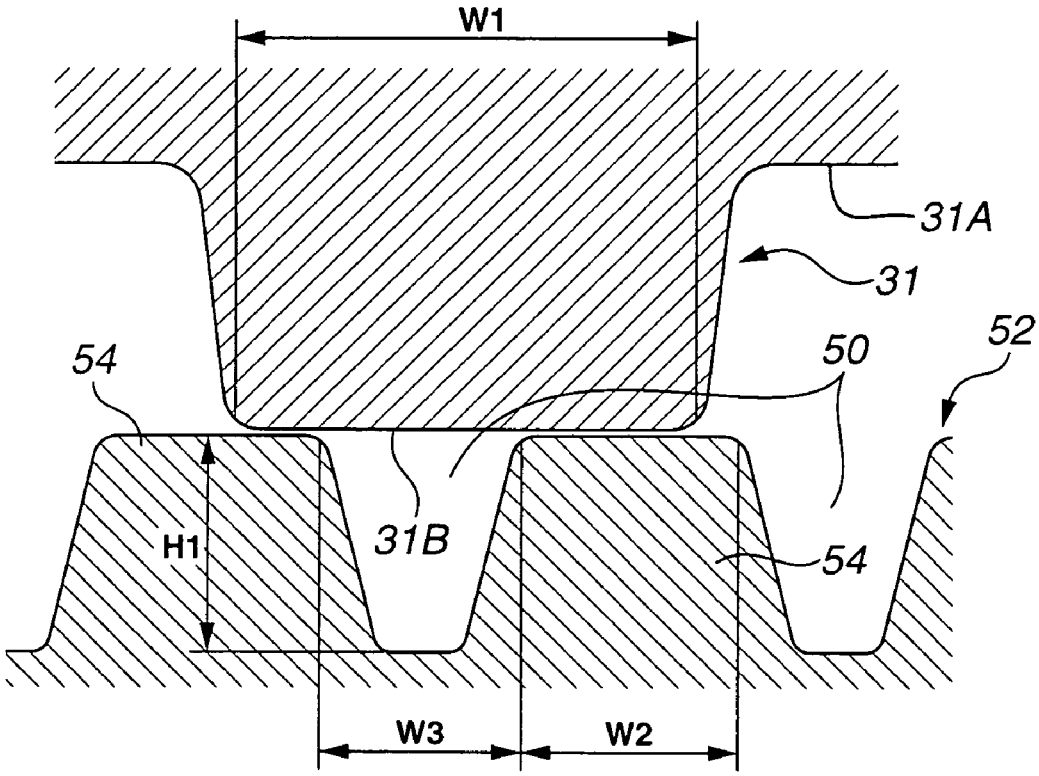
FIG. 3 is an enlarged schematic cross-section of microstructures of mutually contacting surfaces of the input pulley and a metal element of the belt shown in FIG. 2.

FIG. 3 is an enlarged cross-sectional view of microstructures formed on respective side faces 31 of metal element 30 and respective tapered surfaces 52 of pulley halves 11 and 12 of primary pulley 1 which are in mutual contact with each other, taken along a radial direction of primary pulley 1. Each of side faces 31 of metal element 30 has microscopic recesses 31A and projections 31B which are formed along the thickness direction of metal element 30, namely, along a circumferential direction of pulley halves 11 and 12 of primary pulley 1 upon being in contact with tapered surface 52 of each of pulley halves 11 and 12. With the provision of recesses 31A and projections 31B, lubrication oil is allowed to appropriately discharge from the tapered surface in a rotational direction of primary pulley 1. This results in avoidance of reduction in friction between endless belt 3 and primary pulley 1 due to so-called surfing effect.

Tapered surface 52 of each of pulley halves 11 and 12 of primary pulley 1 is formed with concentric microgrooves 50 as shown in FIG. 1B. The shape of microgrooves 50 on tapered surfaces 52 of pulley halves 11 and 12 of primary pulley 1 is optional as long as they are arranged in a substantially radially equidistantly spaced relation to each other. For instance, microgrooves 50 may be in the form of a helical groove.

As illustrated in FIG. 3, a plurality of microprojections 54 are defined between microgrooves 50 on tapered surfaces 52 of pulley halves 11 and 12 of primary pulley 1. Thus, microgrooves 50 and microprojections 54 are alternately arranged in the radial direction of primary pulley 1. In FIG. 3, W1 represents a width of a top surface of each of projections 31B which extends in a direction perpendicular to the thickness direction and the length direction of metal element 30; W2 represents a width of a top surface of each of microprojections 54 which extends in the radial direction of primary pulley 1; W3 represents a width of each of microgrooves 50; and H1 represents a height of microprojections 54, i.e., a depth of microgrooves 50. Specifically, the width W3 is a radial distance between the top surfaces of the adjacent microprojections 54, namely, between both end peripheries of microgroove 50 opposed in the radial direction of primary pulley 1. A pitch between respective microgrooves 50 is represented by Sm that is a sum of the width W2 of microprojection 54 and the width W3 of microgroove 50, namely, Sm=W2+W3. Tapered surface 52 of each of pulley halves 11 and 12 of primary pulley 1 has a microstructure in which surface roughness Ra is in a range of 0.05-0.25 μm, height H1 of microprojection 54 is in a range of 0.5-2.5 μm, and pitch Sm of microgrooves 50 is 30 μm or less.

Recesses 31A and projections 31B on side faces 31 of metal element 30 and microgrooves 50 on tapered surfaces 52 of pulley halves 11 and 12 of primary pulley 1 are formed such that the sum of the width W2 of microprojection 54 and the width W3 of microgroove 50, namely, pitch Sm of microgrooves 50, is not more than the width W1 of projection 31B. More specifically, at any contact position between metal element 30 and tapered surfaces 52 of pulley halves 11 and 12 of primary pulley 1, one or more microgrooves 50 are always located opposed to one projection 31B.

Side faces 31 of metal element 30 are basically contacted with tapered surfaces 52 of pulley halves 11 and 12 of primary pulley 1 and tapered surfaces 53 of pulley halves 21 and 22 of secondary pulley 2 through an oil film. The oil film includes a torque-transmitting film that is adsorbed by additive components contained in the lubrication oil to generate a shear force, and a lubrication film functioned as a lubrication oil. Therefore, in order to adequately control the oil film, it is required to form the torque-transmitting film while discharging a suitable amount of an oil constituting the lubrication film from the contact portion between side faces 31 of metal element 30 and tapered surfaces 52 and 53 of primary pulley 1 and secondary pulley 2. In this embodiment of the present invention, each of projections 31B having width W1 on side faces 31 of metal element 30 is always opposed to at least one of microgrooves 50 on tapered surfaces 52 of primary pulley 1 through which the amount of oil constituting the lubrication film can be discharged. As a result, discharge of the amount of oil constituting the lubrication film from tapered surface 52 can be enhanced, and the torque-transmitting film can be efficiently formed. This ensures a suitable contact between side faces 31 of metal element 30 and tapered surfaces 52 of primary pulley 1 and increases a friction coefficient thereof.

As shown in FIG. 1B, microgrooves 50 are formed on a radially inward region of tapered surface 52 of each of pulley halves 11 and 12 of primary pulley 1 where a pulley ratio is 1 or more. The reason therefor is as follows. That is, in the radially inward region where the formula of pulley ratio≧1 is satisfied, the torque applied to the pulleys becomes large since the radius of contact between endless belt 3 and primary pulley 1 is small, so that a torque shared by individual metal element 30 is increased. Owing to forming microgrooves 50 in such a minimum area, i.e., the radially inward region of tapered surface 52, the high friction coefficient can be attained, and at the same time, the number of processing steps can be reduced. As a matter of course, microgrooves 50 may be formed on other areas of tapered surface 52 of primary pulley 1 in addition to the radially inward region satisfying the formula of pulley ratio≧1. Further, microgrooves 50 may be formed on a radially outward region of tapered surface 53 of secondary pulley 2 which is located outside a region corresponding to the radially inward region of tapered surface 52 of primary pulley 1 satisfying the formula of pulley ratio≧1.

A first embodiment of the process of producing a pulley for a belt drive CVT, according to the present invention, will be explained hereinafter. In the first step, a preform of primary pulley 1 is prepared, and then axially opposed tapered surfaces of the preform is subjected to surface hardening. The surface hardening is not limited to a specific treatment, and may include carburizing, quenching and tempering.

In the second step, the surface-hardened tapered surfaces of the preform are subjected to hard turning to form microgrooves substantially equidistantly spaced from one another in the radial direction of the tapered surfaces. The microgrooves are thus in the form of concentric or helical grooves. Upon forming the microgrooves, a pitch of the microgrooves is controlled to 30 μm or less. Specifically, the preform is fixedly set to a lathe, and the lathe is driven so as to form the microgrooves on each of the tapered surfaces using a tool having a roundness R of 0.1 mm at a feed speed of 0.01-0.03 mm. Thus, the microgrooves having the pitch of 30 μm or less corresponding to the feed speed are formed, and microprojections are formed between the microgrooves. The microgrooves are formed on a radially inward region of the surface-hardened tapered surfaces of the preform in which the pulley ratio is 1 or more. The microgrooves may be formed beyond the radially inward region satisfying the formula of pulley ratio≧1. Further, after subjecting axially opposed tapered surfaces of a preform of secondary pulley 2 to hard turning, the microgrooves may be formed on a radially outward region of the surface-hardened tapered surfaces of the preform of secondary pulley 2 corresponding to the radially inward region of the surface-hardened tapered surface of the preform of primary pulley 1.

Figure 9:
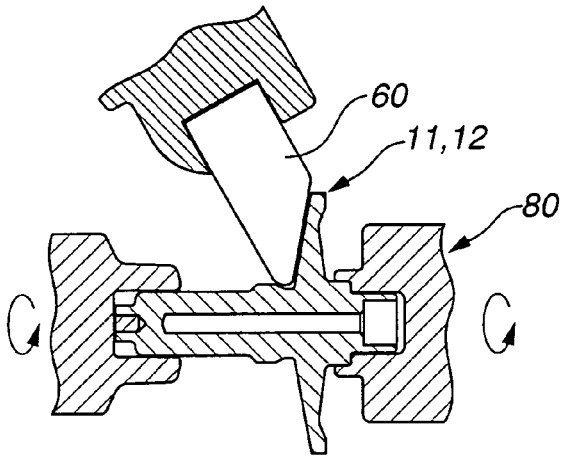
FIG. 9 is a schematically explanatory diagram illustrating a finishing step using a formed grindstone, according to a first embodiment of the process of the present invention.
Figure 10:
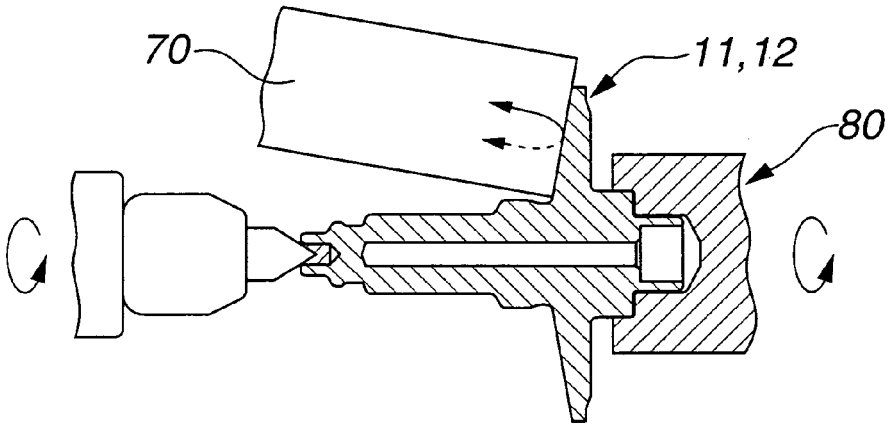
FIG. 10 is a schematically explanatory diagram illustrating a film lapping step used in a modification of the first embodiment of the process of the present invention.
Figure 11:
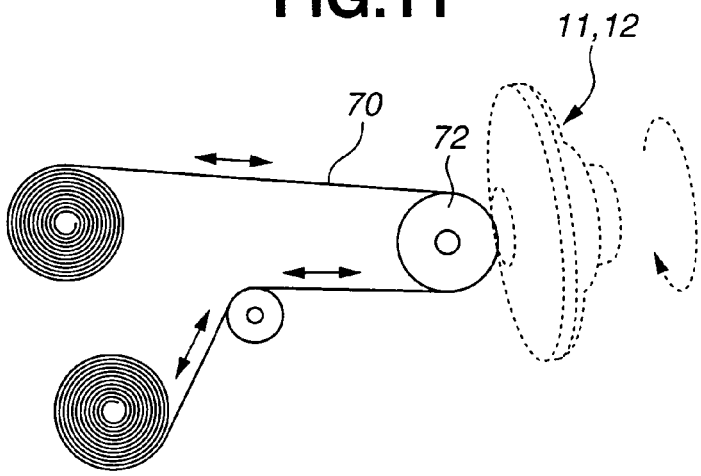
FIG. 11 is a plan view of FIG. 10.
Figure 12:
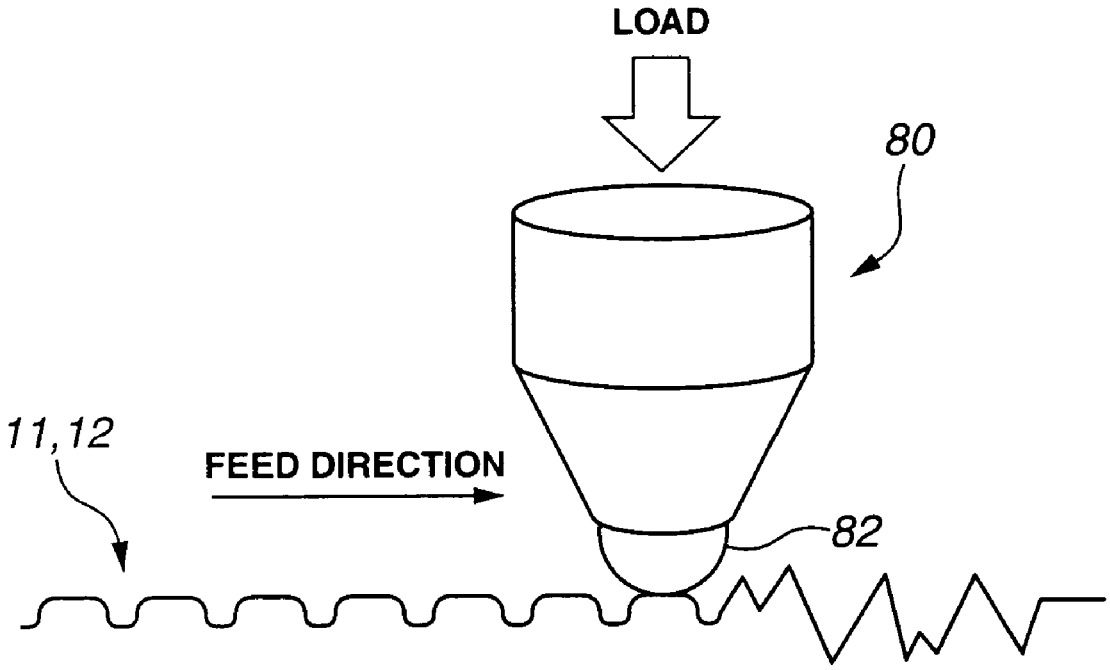
FIG. 12 is a schematic explanatory diagram illustrating a spherical tool used in the first embodiment of the process of the present invention.

Subsequently, a height of the microprojections on the surface-hardened tapered surfaces of the preform of primary pulley 1 is controlled to a range of 0.5-2.5 μm. Namely, surface roughness Ra of the surface-hardened tapered surfaces of the preform is reduced to a range of 0.05-0.25 μm. Specifically, the height of the microprojections is reduced by undergoing plastic deformation using a cylindrical tool or a spherical tool. The microprojections may be subjected to roller burnishing to be plastically deformed so as to reduce the height thereof. The cylindrical tool has a shape of roller 72 as shown in FIG. 11. The spherical tool is indicated at 80 in FIG. 12. The spherical tool is a so-called ball point tool with ball 82 having a considerably large diameter as compared to a surface roughness of the surface-hardened tapered surfaces of the preform. Both of the cylindrical tool and the spherical tool are pressed against tips of the microprojections on the surface-hardened tapered surfaces of the preform to cause the plastic deformation thereof. The cylindrical tool and the spherical tool can attain the same effect of allowing the microprojections to be plastically deformed. The roller burnishing may be replaced by finishing using formed grindstone 60 as shown in FIG. 9, or by film lapping by reciprocally moving film grindstone 70 as shown in FIGS. 10 and 11, in the radial direction of the preform. As a result, thus-formed primary pulley 1 has the microstructure of tapered surfaces 52 as shown in FIG. 3, in which pitch Sm of microgrooves 50 is 30 μm or less, surface roughness Ra is in the range of 0.05-0.25 μm, and height H1 of microprojections 54 is in the range of 0.5-2.5 μm.

A second embodiment of the process of the present invention, will be explained hereinafter. In the first step, similar to the first embodiment, a preform of primary pulley 1 is prepared and then axially opposed tapered surfaces of the preform is subjected to surface hardening. In the second step, the surface-hardened tapered surfaces of the preform are subjected to shot peening. In the third step, the shot-peened tapered surfaces of the preform are subjected to finishing to form concentric or helical microgrooves thereon having a substantially equal pitch. The finishing may be conducted using formed grindstone 60 as shown in FIG. 9 or film grindstone 70 as shown in FIGS. 10 and 11. Thus-formed primary pulley 1 has the microstructure of tapered surfaces 52 as shown in FIG. 3, in which pitch Sm of microgrooves 50 is 30 μm or less, surface roughness Ra is in the range of 0.05-0.25 μm, and height H1 of microprojections 54 is in the range of 0.5-2.5 μm. The microgrooves are formed on the radially inward region of the surface-hardened tapered surfaces of the preform of primary pulley 1 as described in the first embodiment, and may be formed beyond the region. In addition, after subjecting axially opposed tapered surfaces hardened of a preform of secondary pulley 2 to surface hardening, the microgrooves may be formed on the surface-hardened tapered surfaces of the preform of secondary pulley 2 in the radially outward region as explained in the first embodiment.

Test for Evaluation of Various Parameters Defining Microstructure of Tapered Surface of Pulley:

The microstructure of the tapered surfaces of the pulley capable of accomplishing the above effects is defined by parameters, i.e., surface roughness Ra, pitch Sm of microgrooves and height H1 of microprojection. These parameters Ra, Sm and H1 will be explained in detail later. In this evaluation test, a metal element of the belt was prepared, in which the pitch of microscopic projections and recesses on side faces of the metal element was about 200 μm, and the width W1 of the microscopic projections was about 30 μm. A plurality of test specimens of the pulley which had various ranges of surface roughness Ra and pitch Sm of microgrooves were prepared. The thus-prepared metal element of the belt and test specimens of the pulley were used in the test. In the test, while contacting the metal element with the surfaces of the test specimen under a load of 392 N, the metal element was continuously slid over the surface of the test specimen so as to move up and down relative to the surface thereof at a speed of 0 to 0.8 m/s in a CVT lubrication oil having an oil temperature of 110° C. to measure friction coefficient μ thereof upon the down slide movement. The above test condition corresponds to Low-gear ratio upon mounting the belt drive CVT to actual vehicles.

Figure 4:
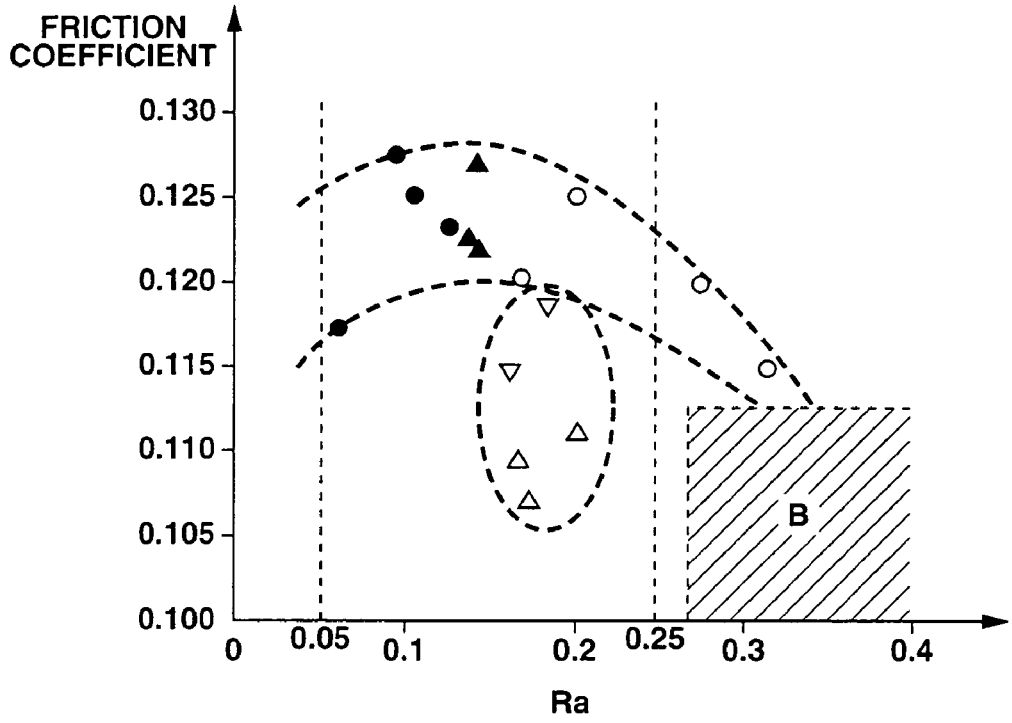
FIG. 4 is a diagram illustrating a relationship between surface roughness Ra and friction coefficient of test specimens used in a slide test.

Surface Roughness Ra:

FIG. 4 illustrates a relationship between surface roughness Ra and friction coefficient μ of the test specimens. In FIG. 4, marks (○) represent the results of measurement of the friction coefficient μ of the test specimen prepared by subjecting the surface thereof to grinding. Marks (●) represent the results of measurement of the friction coefficient μ of the test specimen prepared by subjecting the surface thereof to grinding and then roller burnishing to control height H1 of microprojection and decrease the surface roughness Ra. Marks (Δ) represent the results of measurement of the friction coefficient μ of the test specimen prepared by subjecting the surface thereof to shot peening using shots having a diameter of 0.05 mm to control the surface roughness Ra thereof. Marks (▽) represent the results of measurement of the friction coefficient μ of the test specimen prepared by subjecting the surface thereof to shot peening using shots having a diameter of 0.03 mm to control the surface roughness Ra thereof. Marks (▲) represent the results of measurement of the friction coefficient μ of the test specimen prepared by subjecting the surface thereof to shot peening using shots having a diameter of 0.05 mm and then subjected to film lapping to control the surface roughness Ra thereof.

Figure 6:
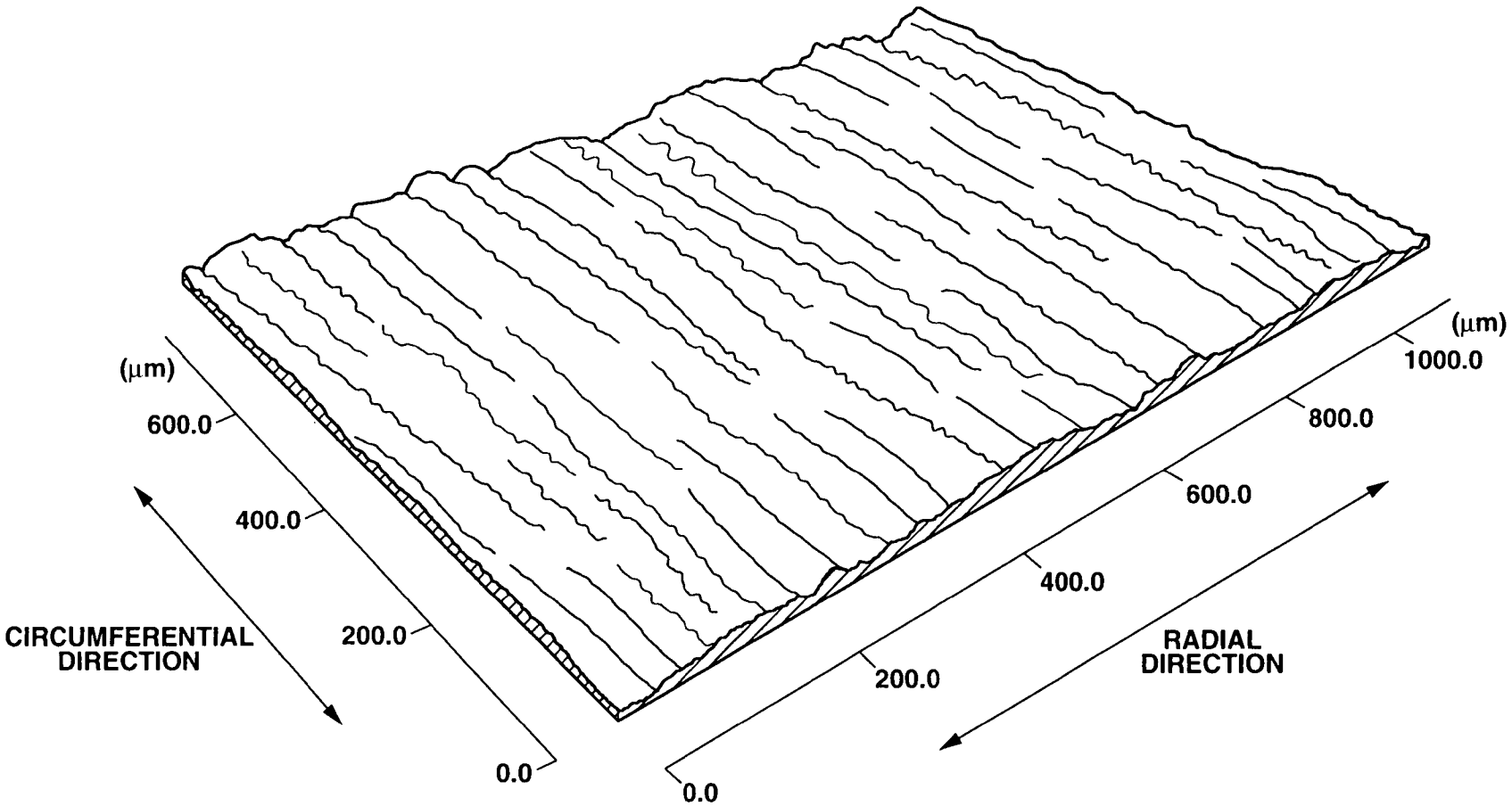
FIG. 6 is a three-dimensional bird's-eye view showing a microstructure of a surface of one of the test specimens.
Figure 7:
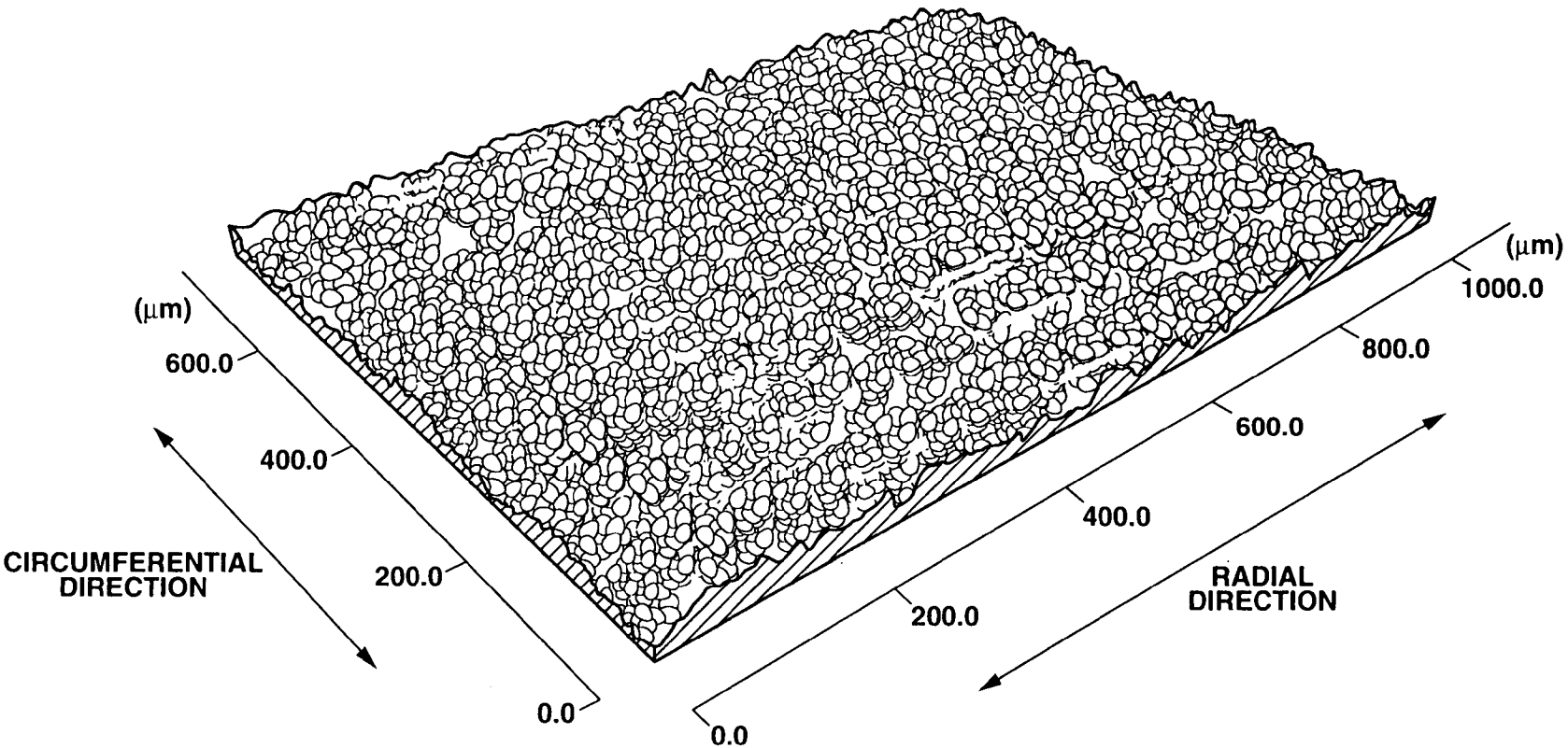
FIG. 7 is a view similar to FIG. 6, but showing a microstructure of a surface of another of the test specimens.
Figure 8:
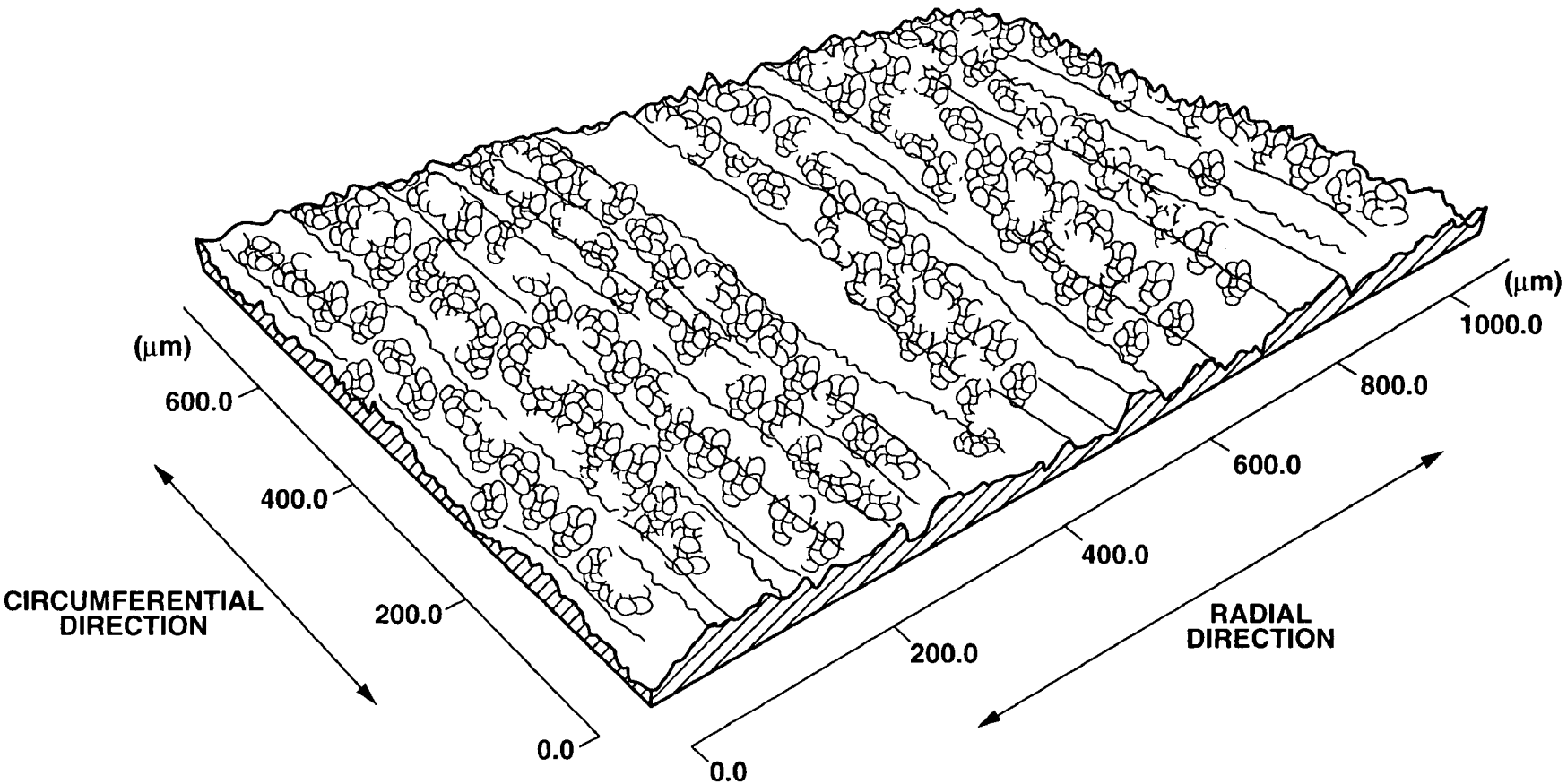
FIG. 8 is a view similar to FIG. 6, but showing a microstructure of a surface of another of the test specimens.

FIG. 6 is a three dimensional birds-eyes view (perspective view) showing a microstructure of the surface of the test specimen as indicated by the marks (○) in FIG. 4. FIG. 7 is a three dimensional birds-eyes view (perspective view) showing a microstructure of the surface of the test specimen as indicated by the marks (Δ) in FIG. 4. FIG. 8 is a three dimensional birds-eyes view (perspective view) showing a microstructure of the surface of the test specimen as indicated by the marks (▲) in FIG. 4.

The surface roughness Ra is defined as the value obtained by determining a region in a surface profile which includes microprojections and microgrooves located above a mean line of heights of the microprojections when folding back the microgrooves on the mean line, and then dividing an area per unit length of the region by the length. Accordingly, surface roughness Ra, and pitch Sm of the microgrooves, and height H1 of the microprojection generally have the relationship represented by the following formula:

$$Ra=k\cdot f(Sm)\cdot g(H1),$$

wherein f and g respectively represent a function showing an average value that is determined by a shape of the microgrooves; and k represents a constant. Basically, as Sm is increased, f(Sm) is increased, and as H1 is increased, g(H1) is increased.

Comparison Between the Process Using Grinding Solely and that Using Both Grinding and Roller Burnishing:

In the conventional arts as shown by hatched portion B in FIG. 4, the surface roughness Ra was 0.28 or more and the friction coefficient thereof was less than 0.113. Whereas, as shown by the marks (○) in FIG. 4 in which the test specimen was subjected to grinding solely, it is understood that when the surface roughness Ra of the surface formed with the microgrooves is reduced to 0.25 or less, the friction coefficient μ can be improved.

In comparison with the test specimen subjected to grinding solely as shown by the marks (○) in FIG. 4, it was recognized that the friction coefficient μ was further improved in the test specimen which was subjected to both of grinding and roller burnishing to reduce the height H1 of the microprojection and the surface roughness Ra of the surface formed with the microgrooves, specifically $0.05 \leqq Ra \leqq 0.25$, as shown by the marks (●) in FIG. 4. Meanwhile, the roller burnishing process for controlling the height H1 of the microprojection serves for not only reducing the surface roughness Ra, but also appropriately smoothening the top surface of the microprojection on the surface. As a result, the area ensuring formation of the torque transmitting film is increased, thereby enabling the friction coefficient μ thereof to be improved. If the surface roughness Ra is less than 0.05, the microgrooves tend to be deteriorated in the effect of discharging the lubrication oil from the tapered surface. Therefore, the surface roughness Ra is preferably 0.05 or larger, i.e., $Ra \geqq 0.05$. Meanwhile, the height H1 of the microprojection corresponding to the above surface roughness Ra is in the range of 0.5 to 2.5 μm. Therefore, the microgrooves are preferably formed such that the height H1 of the microprojection lies in this range.

Comparison Between the Process Using Shot Peening Solely and that Using Both Shot Peening and Film Lapping:

In comparison with the test specimens subjected to shot peening using the diameters of the shots of 0.05 mm and 0.03 mm, respectively, it was recognized that the friction coefficient μ was improved though the surface roughness Ra was not largely changed as shown by the marks (Δ) and (∇) in FIG. 4. Also, it was recognized that when the test specimen was subjected to shot peening using the 0.05 mm ϕ shots and then to film lapping, the friction coefficient μ was increased as shown by the marks (▲) in FIG. 4, as compared to the friction coefficient μ of the test specimen subjected to shot peening using smaller 0.03 mm ϕ shots as shown by the marks (∇) in FIG. 4. The reason therefor is considered to be that the film lapping process ensures formation of the torque transmitting film while adequately discharging the lubrication oil from the tapered surfaces. As shown in FIG. 8, the microgrooves similar to those shown in FIG. 6 are formed on the surface of the test specimen by both shot peening and film lapping. Meanwhile, it is recognized that upon comparison under the same surface roughness Ra, the friction coefficient μof the surface obtained by both shot peening and film lapping was more excellent than that obtained by shot peening solely.

Figure 5:
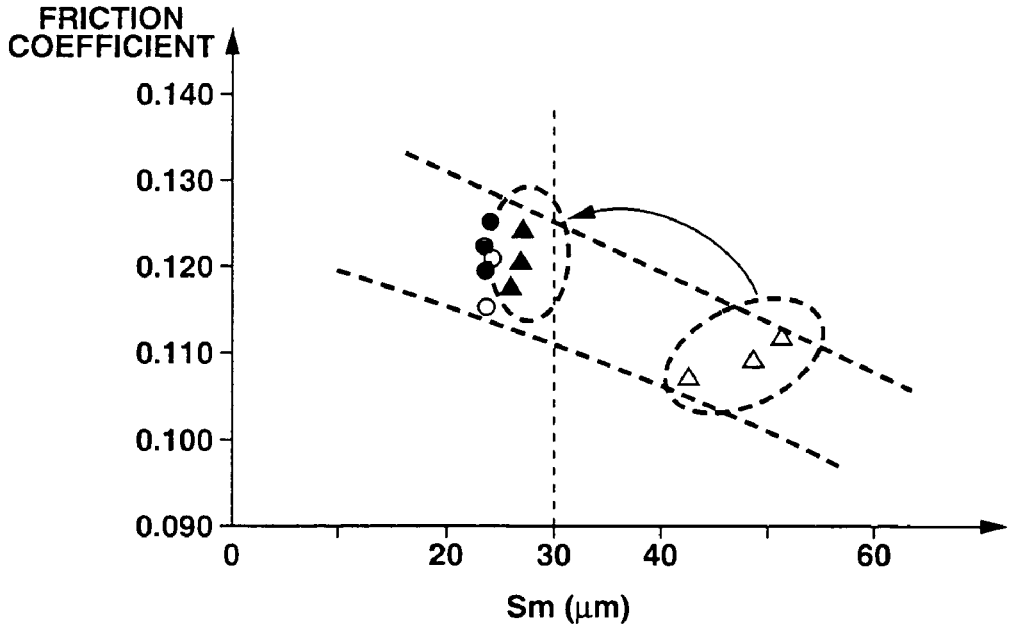
FIG. 5 is a diagram illustrating a relationship between pitch Sm and friction coefficient of the test specimens used in the slide test.

Pitch Sm:

FIG. 5 shows a relationship between pitch Sm of microgrooves and friction coefficient μ of the test specimens. In FIG. 5, the marks (○), (●), (Δ), (∇) and (▲) are used to denote the measurement results of the same test specimens as explained in FIG. 4. It was recognized that a sufficient friction coefficient μwas not ensured in the test specimen subjected to shot peening solely to have an average pitch Sm of more than 40 μm as shown by the marks (Δ) in FIG. 5. On the contrary, it was recognized that the friction coefficient μ was increased as shown by the marks (▲) in FIG. 5 in the test specimen subjected to both shot peening and film lapping to control the pitch Sm to about 30 μm. More specifically, by adjusting the pitch Sm of microgrooves 50 to about 30 μm while setting the surface roughness Ra to an adequate value, it becomes possible to improve the friction coefficient μ.

In addition, the roller burnishing or the film lapping performed after forming the microgrooves by hard turning basically gives an influence on not the pitch Sm of microgrooves 50 but the height H1 of microprojection 54. Therefore, the pitch Sm of microgrooves 50 obtained by subjecting to the roller burnishing is indicated as the substantially same value (30 μm or less) as shown by the marks (●) and (○). As a result, it is recognized that when the microgrooves are formed on the tapered surfaces by grinding, a suitable surface microstructure can be produced by appropriately controlling both the surface roughness Ra thereof and the pitch Sm of the microgrooves.

In the following, the function and effect of the first embodiment of the process of the present invention are explained.

(1) In the second step of forming the microgrooves on the tapered surfaces of the preform of the pulley subsequent to the first step of surface hardening of the tapered surfaces of the preform, the pitch of the microgrooves is controlled to the above-described range. Subsequently, in the third step, the height of the microprojection on the tapered surfaces of the preform is controlled to the above-described range. Thus, the pitch of the microgrooves and the height of the microprojection are independently controlled in the second and third steps, respectively. This can facilitate stable production of the microstructure of the tapered surfaces of the pulley with a high dimensional accuracy.

Further, rough grinding is already completed by the hard turning in the second step of the process of the first embodiment of the present invention, an amount of reduction of the height of the microprojection is relatively small. This can prevent the above-described problems which tend to occur in a case where the microstructure of the tapered surfaces of the pulley is produced in a single step as described in the conventional process.

(2) In the third step of the process of the first embodiment of the present invention, the microprojections on the tapered surfaces of the preform are subjected to roller burnishing using a cylindrical tool or a spherical tool to undergo plastic deformation. Accordingly, the surface hardness of the tapered surfaces of the preform can be further increased by work hardening. In addition, since a compressive residual stress is imparted to the tapered surfaces of the preform, strengths against peeling wear, adhesion or cohesion or wear by abrasives which are required for the tapered surfaces of the pulley can be considerably enhanced.

The process of the second embodiment of the present invention can attain substantially the same effects as those in the process of the first embodiment.

The function and effect of the microstructure of the surface of the pulley according to the present invention will be explained hereinafter.

(1) As shown in FIG. 3, concentric or helical microgrooves 50 are formed on tapered surface 52 of primary pulley 1 such that a sum of the width W3 of microgroove 50 and the width W2 of microprojection 54, namely, the pitch Sm of microgrooves 50, is not more than the width W1 of projection 31B formed on side face 31 of metal element 30 of belt 3. With this arrangement, one or more microgrooves 50 are surely disposed in an opposed relation to projection 31B of metal element 30, thereby ensuring smooth discharge of the lubrication oil from tapered surface 52 as well as a sufficient contact area between tapered surface 52 and metal element 30 via the torque transmitting film.

(2) The surface roughness Ra of tapered surface 52 formed with microgrooves 50 is within the range of 0.05 to 0.25 μm. In this range, it is possible to ensure a good friction coefficient of tapered surface 52 in a stable manner as shown in FIG. 4.

(3) The height H1 of microprojection 54 on tapered surface 52 is within the range of 0.5 to 2.5 μm. Since the height H1 is adjusted so as to correspond to the above adequate surface roughness Ra, it is possible to ensure a sufficient area on the top surface of microprojection 54, and therefore, increase an area where the torque transmitting film is formed.

(4) The pitch Sm of microgrooves 50 is 30 μm or less. In this range, as shown in FIG. 5, even under the same surface roughness Ra, it is possible to ensure a higher friction coefficient.

(5) Microgrooves 50 are formed on the region of tapered surface 52 where a pulley ratio is 1 or more. Thus, microgrooves 50 are formed on only the region requiring a high friction coefficient, whereby the pulley processing time can be shortened.

This application is based on prior Japanese Patent Application No. 2004-091985 filed on Mar. 26, 2004. The entire contents of the Japanese Patent Application No. 2004-091985 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A process for producing a pulley for a continuously variable belt drive transmission including an input pulley, an output pulley and an endless belt disposed between the input and output pulleys, the input and output pulleys having tapered surfaces contacted with the endless belt, respectively, the endless belt including a plurality of metal elements stacked on each other in a thickness direction thereof, the metal elements each having a plurality of microscopic projections and recesses on opposed side faces which are contacted with the tapered surfaces of the input and output pulleys, the tapered surfaces of at least one of the input and output pulleys being formed with microgrooves in the form of concentric grooves or a continuous helical groove, in which a relationship represented by the following expression: W1≧(W2+W3), wherein W1 is a width of each of the microscopic projections on the side faces of the metal elements, W2 is a width of a top surface of each of microprojections defined between the adjacent microgrooves, and W3 is a width of each of the microgrooves, is satisfied, the process comprising:

subjecting tapered surfaces of a preform of at least one of the input pulley and the output pulley to surface hardening;

subjecting the surface-hardened tapered surfaces of the preform to hard turning to form the microgrooves radially spaced from one another thereon, between which microprojections are formed; and reducing a height of the microprojections to thereby provide the at least one of the input pulley and the output pulley having the tapered surfaces with the microgrooves which satisfy said relationship.

2. The process as claimed in claim 1, wherein the hard turning is conducted to control a pitch of the microgrooves to 30 μm or less.

3. The process as claimed in claim 1, wherein the hard turning is conducted at least a region of the tapered surfaces of the preform in which a pulley ratio is 1 or more.

4. The process as claimed in claim 1, wherein the height of the microprojections is reduced by controlling a surface roughness Ra of the surface-hardened tapered surfaces to a range of 0.05-0.25 μm.

5. The process as claimed in claim 1, wherein the height of the microprojections is reduced by controlling the height of the microprojections to a range of 0.5-2.5 μm.

6. The process as claimed in claim 1, wherein the height of the microprojections is reduced by undergoing plastic deformation.

7. The process as claimed in claim 6, wherein the microprojections undergo the plastic deformation using one of a spherical tool and a cylindrical tool.

8. The process as claimed in claim 7, wherein the plastic deformation of the microprojections is allowed by roller burnishing.

9. The process as claimed in claim 1, wherein the height of the microprojections is reduced using a formed grindstone.

10. The process as claimed in claim 1, wherein the height of the microprojections is reduced by film lapping.

11. The process as claimed in claim 1, wherein the at least one of the input pulley and the output pulley is the input pulley.

12. The process as claimed in claim 1, comprising producing an input pulley and an output pulley pulley set, wherein the hard turning is conducted at least a region of the tapered surfaces of the preform in which a pulley ratio for the input pulley and the output pulley of the set is 1 or more.

13. A process for producing a pulley for a continuously variable belt drive transmission including an input pulley, an output pulley and an endless belt disposed between the input and output surfaces, the input and output pulleys having tapered surfaces contacted with the endless belt, respectively, the endless belt including a plurality of metal elements stacked on each other in a thickness direction thereof, the metal elements each having a plurality of microscopic projections and recesses on opposed side faces which are contacted with the tapered surfaces of the input and output pulleys, the tapered surfaces of at least one of the input and output pulleys being formed with microgrooves in the form of concentric grooves or a continuous helical groove, in which a relationship represented by the following expression: W1≧(W2+W3), wherein W1 is a width of each of the microscopic projections on the side faces of the metal elements, W2 is a width of a top surface of each of microprojections defined between the adjacent microgrooves, and W3 is a width of each of the microgrooves, is satisfied, the process comprising:

subjecting tapered surfaces of a preform of at least one of the input pulley and the output pulley to surface hardening;

subjecting the surface-hardened tapered surfaces of the preform to shot peening; and subjecting the shot-peened tapered surfaces of the preform to finishing to form the microgrooves thereon and thereby provide the at least one of the input pulley and the output pulley which has the tapered surfaces with the microgrooves which satisfy said relationship.

14. The process as claimed in claim 13, wherein the shot peening is conducted at least a region of the tapered surfaces of the preform in which a pulley ratio is 1 or more.

15. The process as claimed in claim 13, wherein the finishing is conducted using a formed grindstone.

16. The process as claimed in claim 13, wherein the finishing is conducted by film lapping.

* * * * *